US006179622B1

(12) United States Patent
Lai et al.

(10) Patent No.: US 6,179,622 B1
(45) Date of Patent: Jan. 30, 2001

(54) MEMORY CARD CONNECTOR

(75) Inventors: Ming-Chun Lai, Shin-Chuang; Hung-Chi Yu, Hsi-Chih, both of (TW)

(73) Assignee: Hon Hai Precision Ind. Co., Ltd., Taiepi Hsien (TW)

( * ) Notice: Under 35 U.S.C. 154(b), the term of this patent shall be extended for 0 days.

(21) Appl. No.: 09/360,073

(22) Filed: Jul. 23, 1999

(30) Foreign Application Priority Data

Jan. 29, 1999 (TW) ..... 88201520

(51) Int. Cl.[7] ..... H01R 12/00
(52) U.S. Cl. ..... 439/64; 439/607
(58) Field of Search ..... 439/64, 607, 541.5, 439/76.1, 946

(56) References Cited

U.S. PATENT DOCUMENTS 5,228,873 * 7/1993 Hirai ..... 439/607
5,286,207 * 2/1994 McHugh ..... 439/64
5,490,791 * 2/1996 Yamada et al. ..... 439/159
5,795,190 * 8/1998 Ono ..... 439/607

* cited by examiner

*Primary Examiner*—T. C. Patel
(74) *Attorney, Agent, or Firm*—Wei Te Chung

(57) ABSTRACT

A memory card connector comprises a dielectric header, a number of contacts received in the header, a shield, an ejector and at least a fixing device. The fixing device can be a pair of screws and a pair of nuts. The dielectric header has a main body and a pair of receiving recesses on opposite sides of the main body. The shield encloses the header and forms a pair of latching clips on opposite side edges corresponding to the receiving recesses of the header. Engaging means is formed on each latching clip for engaging with the receiving recess thereby securely latching the shield to the header. Thus, the shield can remain at a predetermined position during assembly without requiring an external tool when being fixed to the header. Moreover, the shield is not easily separated from the header even if the nuts and the screws become disengaged from each other.

11 Claims, 5 Drawing Sheets

MEMORY CARD CONNECTOR

BACKGROUND OF THE INVENTION

The present invention relates to a memory card connector, and particularly to a memory card connector having latching means for securely latching a shield to a header of the memory card connector thus ensuring effective electromagnetic shielding and enhancing signal transmission quality between the memory card and a connected device.

Signal transmission rates of electronic systems continually increase, generating increased electromagnetic interference, thereby adversely affecting signal transmission quality. Therefore, a shield is commonly mounted to a memory card connector for ensuring signal transmission quality. Pertinent prior art is disclosed in U.S. Pat. No. 5,662,482 as well as Taiwan Patent Application No. 86210606.

A shield of a conventional memory card connector is commonly fixed to a header of the conventional memory card connector by means of a screw assembly. As shown in FIGS. 5 and 6, a shield 80 forms a latching clip 81 on opposite side edges thereof. Each latching clip 81 comprises a lateral plate 811 perpendicularly extending from one side edge of the shield 80 and a bottom plate 812 perpendicularly bending from a bottom edge of the lateral plate 811. The bottom plate 812 is parallel to the shield 80 and defines a hole 813 therein.

When the shield 80 is fixed to a header 82 of the conventional memory card connector, the latching clips 81 are deposited in corresponding receiving recesses 83 defined in the header 82. A nut 84 is positioned on the bottom plate 812 of the corresponding latching clip 81 while a screw 85 extends through the hole 813 for engaging with the nut 84 thereby securely latching the shield 80 to the header 82.

However, the latching clips 81 are positioned in the corresponding receiving recesses 83 without any engagement between the latching clips 81 and the receiving recesses 83. Therefore, when the screws 85 are fit into the corresponding holes 813, an external tool is commonly required to prevent movement of the shield 80. Otherwise the latching clips 81 may be displaced from the receiving recesses 83 changing the position of the shield 80, resulting in a decrease of shielding effectiveness. In addition, since the latching clips 81 are not engaged with the receiving recesses 83, if the nuts 84 and the screws 85 become detached from each other, the shield 80 may separate from the header 82 when the electrical connector is assembled to a computer, thereby degrading the shielding effectiveness of the shield 80.

BRIEF SUMMARY OF THE INVENTION

A main object of the present invention is to provide a memory card connector having latching means for securely latching a shield to a header of the memory card connector using a simplified assembly procedure, thereby achieving high manufacturing efficiency and more effective electromagnetic shielding, and enhancing signal transmission quality.

In accordance with one aspect of the present invention, a memory card connector comprises a header, a plurality of contacts received in the header, a shield, an ejector and at least one fixing device. The shield forms at least a latching clip on opposite side edges thereof covering opposite side edges of a portion of the header. The latching clips are deposited in corresponding receiving recesses defined in the header and form engaging means thereon. The header forms notches corresponding to the engaging means of the latching clips thereby achieving interferential engagement between the latching clips and the receiving recesses. Therefore, the shield can be fixed to the memory card connector without requiring an external tool to maintain the shield at a predetermined position. Moreover, the shield can not be easily separated from the header even if the nuts and the screws become disengaged from each other.

According to above characteristics, each latching clip comprises a first lateral plate perpendicularly extending from a corresponding side edge of a shield and a bottom plate perpendicularly extending from a bottom edge of the lateral plate. An opening is defined in the bottom plate. The first lateral plate forms the engaging means on opposite side edges thereof. The engaging means comprises at least a barb protruding from the opposite side edges of the first lateral plate.

Other objects, advantages and novel features of the invention will become more apparent from the following detailed description when taken in conjunction with the accompanying drawings.

DETAILED DESCRIPTION OF THE INVENTION

Figure 1:
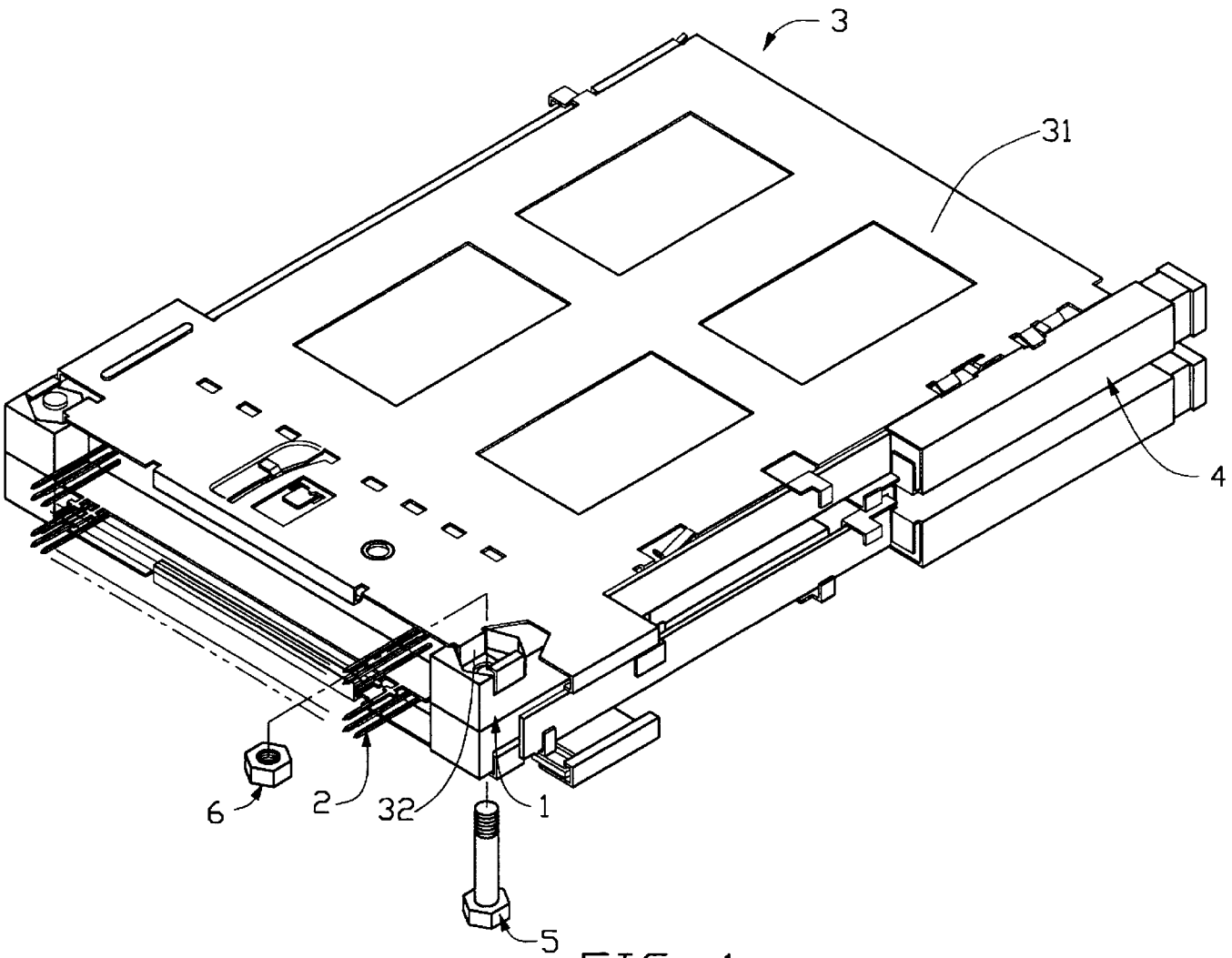
FIG. 1 is a perspective view of a memory card connector in accordance with the present invention.
Figure 2:
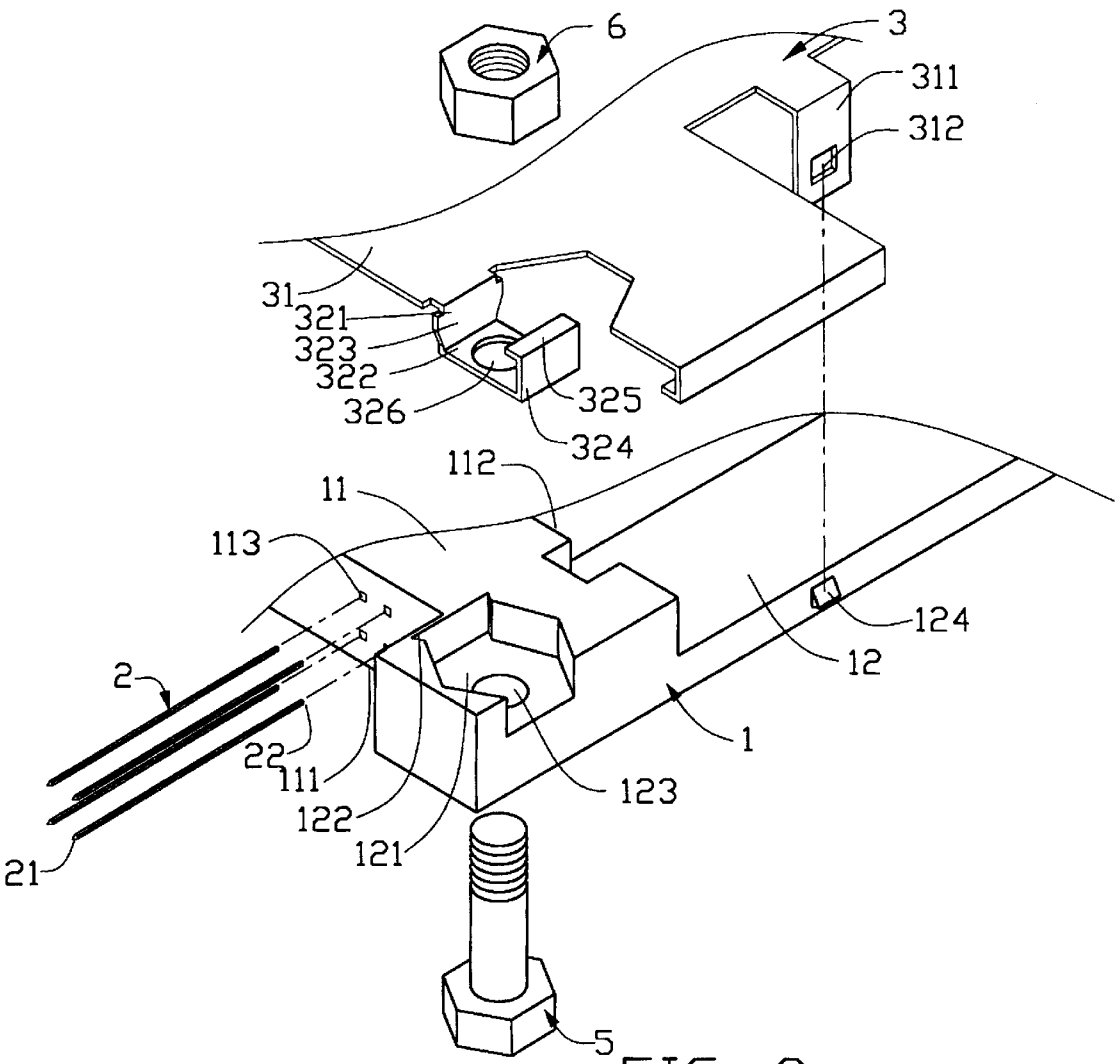
FIG. 2 is an amplified and exploded partial view of the memory card connector.
Figure 4:
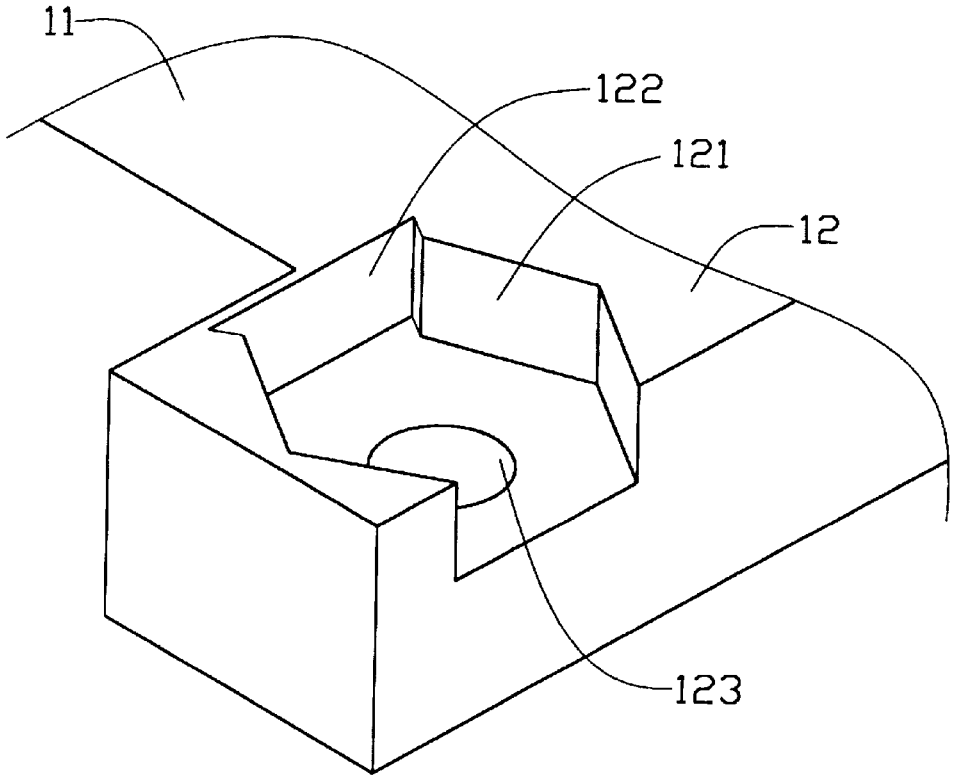
FIG. 4 is an amplified partial view of a header in accordance with the present invention.
Figure 5:
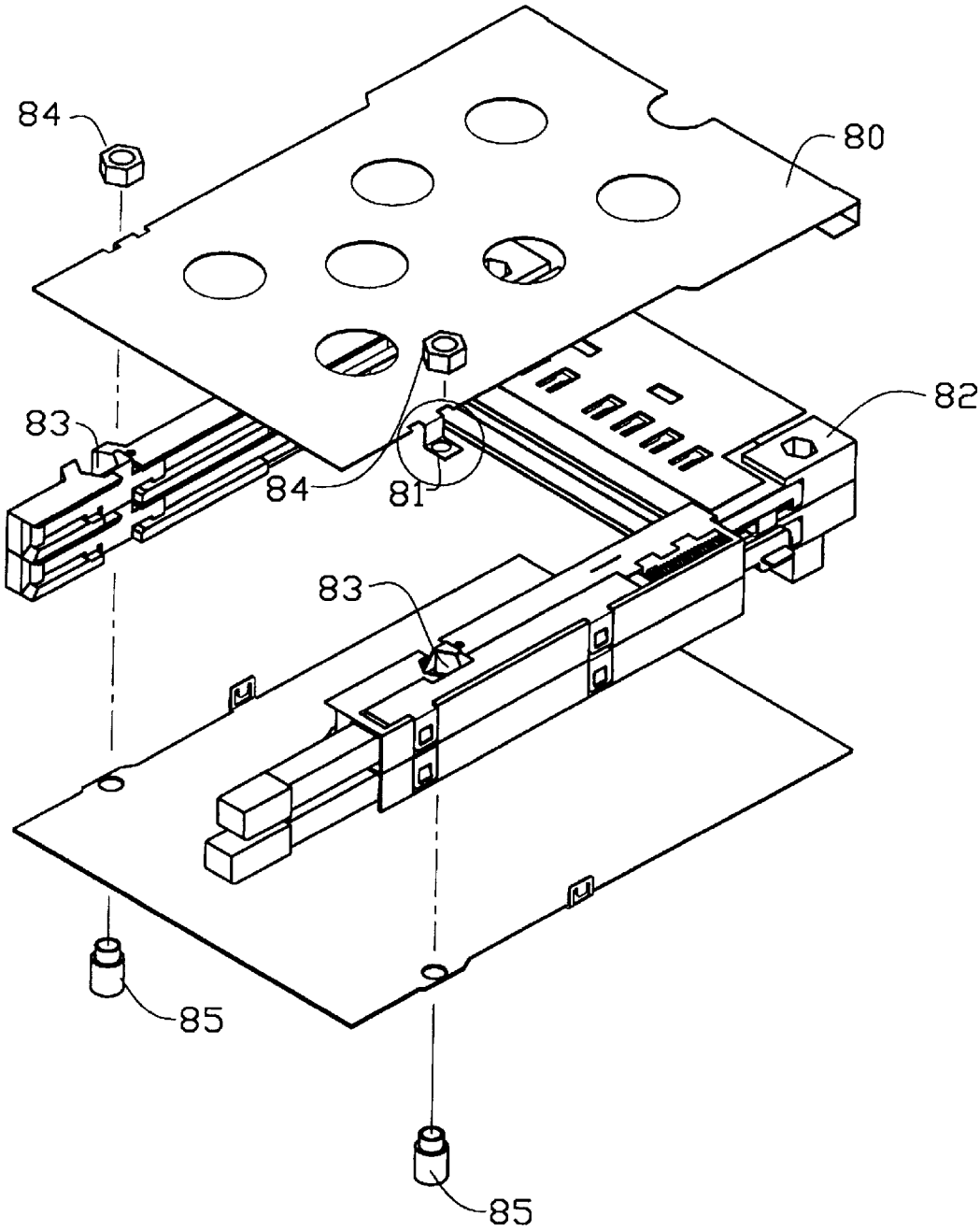
FIG. 5 (PRIOR ART)
FIG. 5 is an exploded view of a conventional memory card connector.
Figure 6:
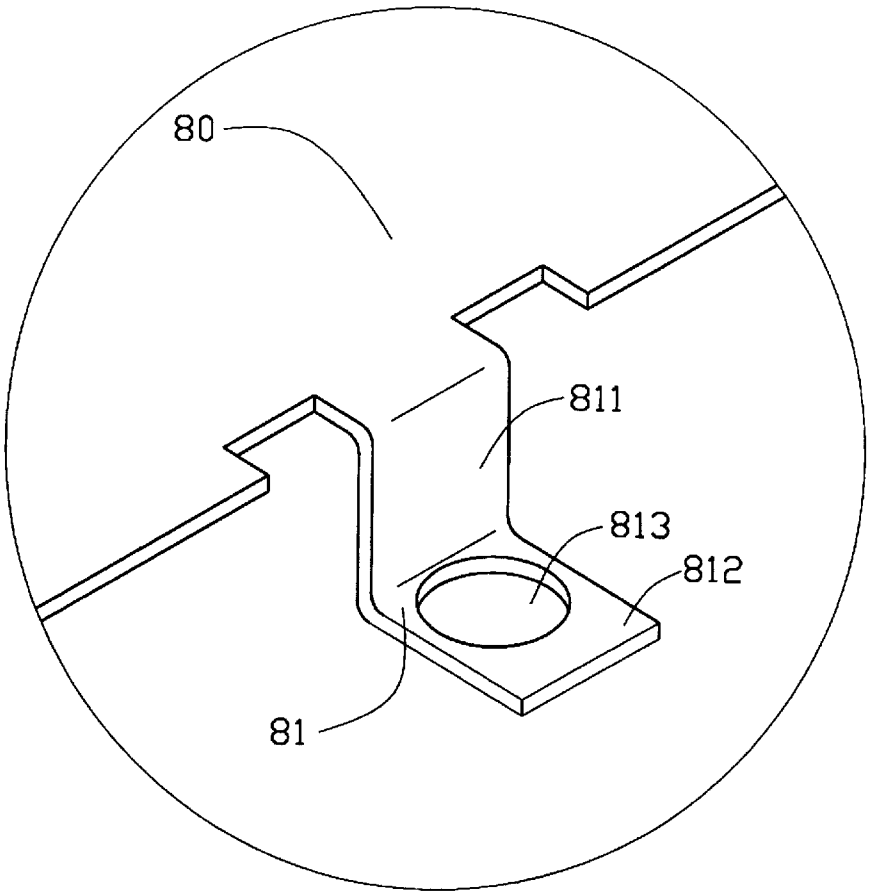
FIG. 6 (PRIOR ART)
FIG. 6 is an amplified perspective view of a latching clip of a shield of the conventional memory card connector.

Referring to FIGS. 1, 2 and 4, a memory card connector in accordance with the present invention comprises a dielectric header 1, a plurality of contacts 2, a shield 3, an ejector 4 and at least one fixing device. The fixing device can be a pair of screws 5 and a pair of nuts 6. The ejector 4 is fixed to one side of the header 1 for withdrawing or inserting a mating memory card (not shown) from or into the memory card connector.

The header 1 comprises an elongate main body 11 forming a pair of opposite end walls 12. A joining surface 111 and a mating surface 112 are formed on opposite sides of the header 1 between the end walls 12. A plurality of engaging slots 113 are defined between the joining surface 111 and the mating surface 112 for receiving the corresponding contacts 2 therein. A pair of hexagonal receiving recesses 121 are defined in portions of the end walls 12 proximate the main body 11 of the header 1. A pair of notches 122 is defined in opposite portions of each receiving recess 121. A screw hole 123 is defined through each end wall 12 in a center of a bottom of each receiving recess 121. A pair of projections 124 are formed on opposite outer surfaces of the end walls 12.

Each contact 2 comprises a joining end 21 and a mating end 22. The joining ends 21 extend beyond the joining surface 111 of the header 1 for being mounted to a circuit board while the mating ends 22 extend beyond the mating surface 112 for electrically connecting with a mating card.

The shield 3 comprises a main plate 31 for covering the main body 11 the header 1 and a pair of latching clips 32 formed on opposite side edges of the main plate 31 corresponding to the receiving recesses 121 of the header 1.

Figure 3:
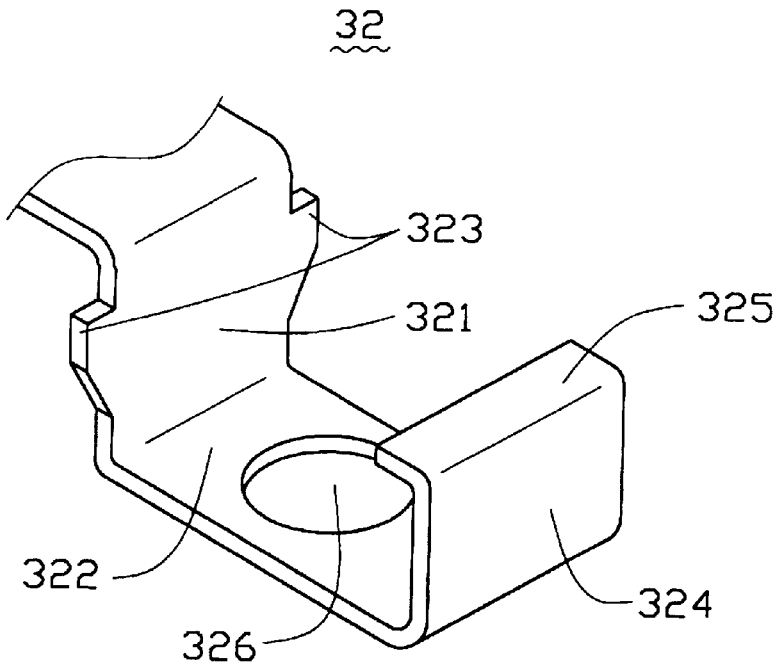
FIG. 3 is an amplified perspective view of a latching clip of a shield of the memory card connector.

Also referring to FIG. 3, the latching clips 32 integrally and perpendicularly extend from opposite side edges of a front portion of the main plate 31. Each latching clip 32 comprises a first lateral plate 321 perpendicularly extending from the corresponding side edge of the main plate 31 and a bottom plate 322 perpendicularly extending from a bottom edge of the first lateral plate 321. The bottom plate 322 is parallel to the main plate 31. The first lateral plate 321 forms a pair of barbs 323 on opposite edges thereof. A second lateral plate 324 perpendicularly extends upward from the bottom plate 322. A free end 325 of the latching clip 32 perpendicularly extends inward from the second lateral plate 324. The second lateral plate 324 is parallel to the first lateral plate 321, while the free end 325 is parallel to the bottom plate 322 thereby defining a space therebetween for receiving the nut 6 therein. An opening 326 is defined in a center of the bottom plate 322 for extension of the screw 5 therethrough to engage with the corresponding nut 6.

The shield 3 forms a pair of L-shaped tabs 311 on opposite side edges corresponding to the projections 124 of the header 1. An aperture 312 is defined in each tab 311 for engaging with the corresponding projection 124.

In assembly, the contacts 2 are received in the corresponding engaging slots 113 of the header 1. The shield 3 is then fixed to enclose the header 1. The apertures 312 defined in the tabs 311 engage with the corresponding projections 124 of the header 1. The latching clips 32 are simultaneously fit in the corresponding receiving recesses 121 and the barbs 323 of the first lateral plate 321 are securely retained in the corresponding notches 122. Therefore, the engagement between the latching clips 32 and the recesses 121 ensures that the shield 3 remains at a predetermined position during assembly without requiring an external tool.

The ejector 4 is fixed to an appropriate position of the memory card connector. The nuts 6 are positioned on the bottom plates 322 of the corresponding latching clips 32. The screws 5 are then inserted through the corresponding screw holes 123 of the header 1 and the openings 326 of the corresponding latching clips 32 to engage with the nuts 6 and complete assembly of the memory card connector. Thus, the shield 3 remains at a predetermined position during assembly without requiring an external tool when being fixed to the header 1. Moreover, the shield 3 is not easily separated from the header 1 even if the nuts 6 and the screws 5 become disengaged from each other.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A memory card connector comprising:

a header comprising a main body forming at least a pair of receiving recesses in opposite ends thereof and a plurality of engaging slots therethrough for receiving contacts therein; and a shield enclosing the header and forming at least one latching clip on each of opposite side edges thereof corresponding to the receiving recesses of the header, each latching clip comprising a first lateral plate perpendicularly extending from the corresponding side edge of the shield and a pair of barbs formed on opposite side edges of the first lateral plate for engaging with the receiving recess to securely latch the shield to the header.

2. The memory card connector as claimed in claim 1, wherein each latching clip comprises a bottom plate perpendicularly extending from a bottom edge of the first lateral plate and defining an opening in a center thereof.

3. The memory card connector as claimed in claim 1, wherein each receiving recess forms a pair of notches in opposite end walls proximate the main body for securely retaining the barbs therein.

4. The memory card connector as claimed in claim 1, wherein a screw hole is formed through a bottom of each receiving recess in a center portion thereof.

5. The memory card connector as claimed in claim 2, wherein each latching clip further comprises a second lateral plate perpendicularly extending from the bottom plate and a free end perpendicularly extending inward from the second lateral plate thereby defining a space therebetween.

6. The memory card connector as claimed in claim 1 further comprising a positioning device for securely fixing the shield to the header.

7. The memory card connector as claimed in claim 6, wherein the positioning device comprises a nut received in the space of a corresponding latching clip and a screw extending through corresponding screw hole of the header and the opening of corresponding latching clip to threadedly engage with the nut.

8. A memory card connector comprising:

a header comprising a main body with at least one receiving recess at one end thereof, a pair of notches formed adjacent to said recess and a screw hole being positioned under the recess;

a shielding enclosing the header and comprising a horizontal main plate with a latching clip at one end thereof, said latching clip including a horizontal bottom plate positioned in the recess with an opening thereof in alignment with the screw hole, a first lateral plate vertically connected between said main plate and said bottom plate; wherein a pair of barbs positioned by two sides of the lateral plate for interferential engagement within the corresponding notches, respectively.

9. The connector as claimed in claim 8, wherein said latching clip further includes a second lateral plate vertically extending from the bottom plate, opposite to the first lateral plate, with an end portion horizontally extending inwardly parallel to the bottom plate for defining a space receiving a nut therein.

10. A memory card connector comprising:

a header comprising a main body with at least one receiving recess at one end thereof, a screw hole being positioned under the recess;

a shielding enclosing the header and comprising a horizontal main plate with a latching clip at one end thereof, said latching clip including a horizontal bottom plate positioned in the recess with an opening thereof in alignment with the screw hole, a first lateral plate vertically connected between said main plate and said bottom plate;

said latching clip further including a second lateral plate vertically extending from the bottom plate, opposite to the first lateral plate, with an end portion horizontally inwardly extending parallel to the bottom plate for defining a space receiving a nut therein.

11. A memory card connector comprising:

a header comprising a main body forming at least a pair of receiving recesses in opposite ends thereof and a plurality of engaging slots therethrough for receiving contacts therein; and a shield enclosing the header and forming at least a latching clip on each of opposite side edges thereof corresponding to the receiving recesses of the header, each latching clip comprising means for engaging with the receiving recess to securely latch the shield to the header; wherein each latching clip comprises a first lateral plate perpendicularly extending from the corresponding side edge of the shield and a bottom plate perpendicularly extending from a bottom edge of the first lateral plate and defining an opening in a center thereof; and wherein each latching clip further comprises a second lateral plate perpendicularly extending from the bottom plate and a free end perpendicularly extending inward from the second lateral plate thereby defining a space therebetween.

* * * * *